US009634404B1

(12) United States Patent
Rowson et al.

(10) Patent No.: US 9,634,404 B1
(45) Date of Patent: Apr. 25, 2017

(54) BEAM STEERING MULTIBAND ARCHITECTURE

(71) Applicants: Sebastian Rowson, San Diego, CA (US); Abhishek Singh, San Diego, CA (US); Jeffrey Shamblin, San Marcos, CA (US); Laurent Desclos, San Diego, CA (US)

(72) Inventors: Sebastian Rowson, San Diego, CA (US); Abhishek Singh, San Diego, CA (US); Jeffrey Shamblin, San Marcos, CA (US); Laurent Desclos, San Diego, CA (US)

(73) Assignee: ETHERTRONICS, INC., San Diego, CA (US)

( * ) Notice: Subject to any disclaimer, the term of this patent is extended or adjusted under 35 U.S.C. 154(b) by 0 days.

(21) Appl. No.: 14/219,002

(22) Filed: Mar. 19, 2014

Related U.S. Application Data

(63) Continuation of application No. 13/968,379, filed on Aug. 15, 2013, now abandoned.

(60) Provisional application No. 61/683,675, filed on Aug. 15, 2012.

(51) Int. Cl.
*H01Q 3/00* (2006.01)
*H01Q 21/29* (2006.01)

(52) U.S. Cl.
CPC ..... *H01Q 21/29* (2013.01)

(58) Field of Classification Search
CPC ..... H01Q 3/00; H01Q 1/243; H01Q 9/0421; H01Q 9/0442
USPC ..... 343/700 MS, 745, 833, 876
See application file for complete search history.

(56) References Cited

U.S. PATENT DOCUMENTS

| | | | | |
|---|---|---|---|---|
| 7,330,152 | B2 * | 2/2008 | Zhang | H01Q 3/24 343/700 MS |
| 7,696,928 | B2 * | 4/2010 | Rowell | H01Q 9/0407 343/700 MS |
| 8,473,017 | B2 * | 6/2013 | Milosavljevic | H01Q 1/241 343/702 |
| 8,760,360 | B2 * | 6/2014 | Kuo | H01Q 1/243 343/850 |
| 2013/0194139 | A1 * | 8/2013 | Nickel | H01Q 5/328 343/703 |

* cited by examiner

*Primary Examiner* — Tho G Phan
(74) *Attorney, Agent, or Firm* — Coastal Patent Law Group, P.C.

(57) ABSTRACT

An active antenna system developed to beam steer at multiple frequency bands provides improved performance for fixed and mobile communication systems. Methods of altering the current mode on a single radiator are described wherein the radiation pattern of the antenna is varied as the antenna modes are altered. Techniques to restrict or expand the frequency bandwidth of the beam steering technique are described to provide the capability to beam steer at receive frequencies or transmit frequencies only, and techniques are described where beam steering can occur at both transmit and receive frequency bands from a single active antenna system.

28 Claims, 17 Drawing Sheets

Frequency Division Duplex (FDD) protocol

Frequency Division Duplex (FDD) protocol

Time Division Duplex (TDD) protocol

Time Division Duplex (TDD) protocol

FIG.9A
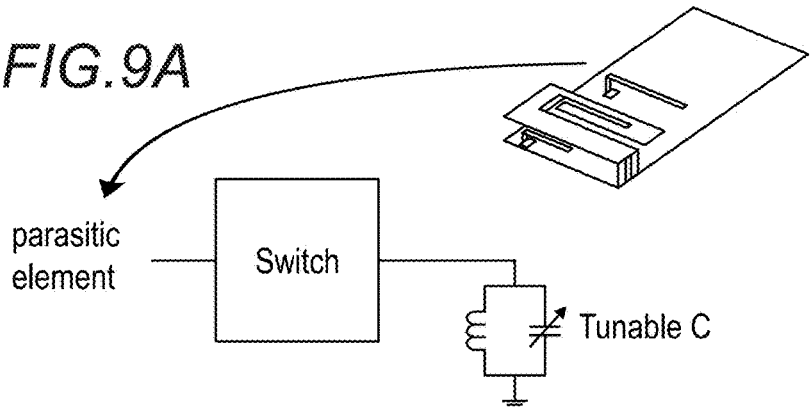
FIG.9B
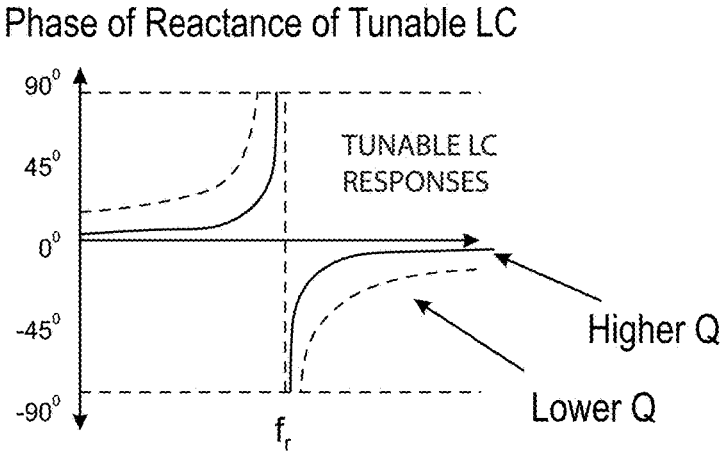
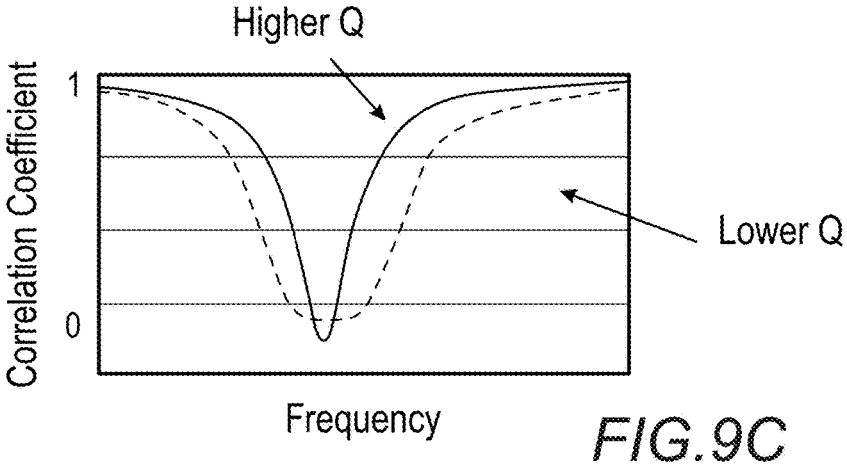
FIG.9C

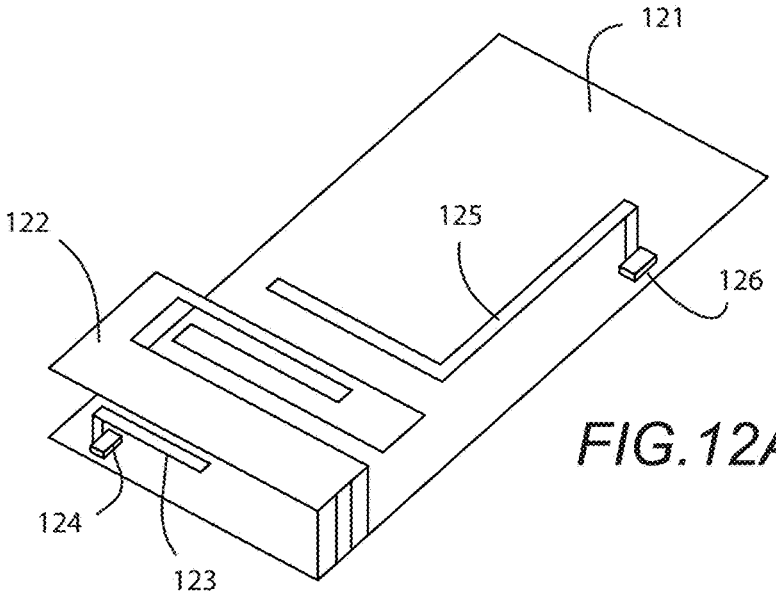
FIG.12A
FIG.12B
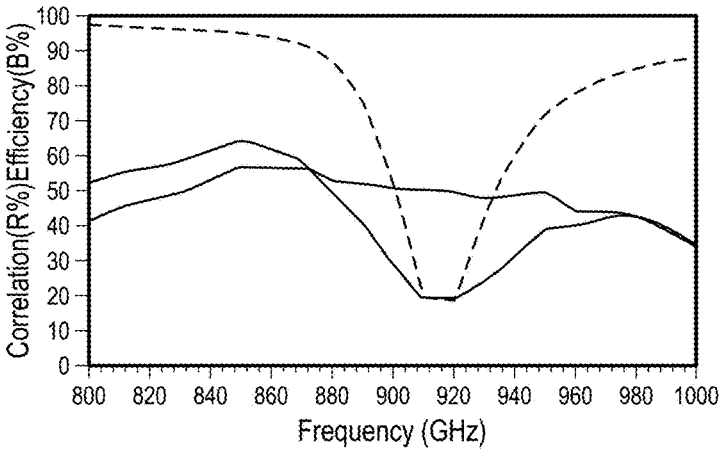
FIG.12C
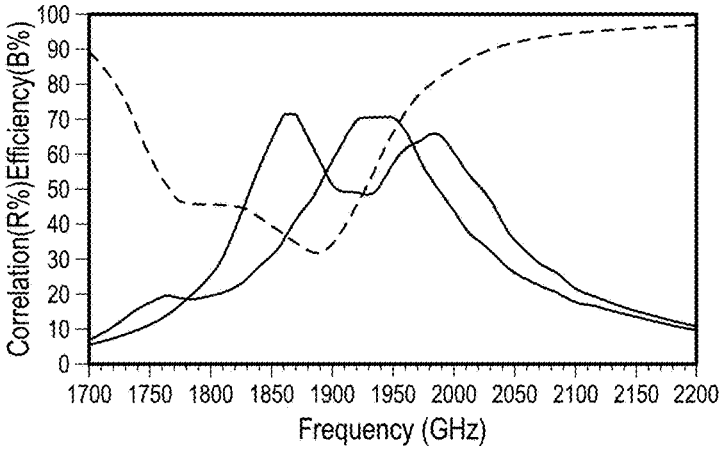

BEAM STEERING MULTIBAND ARCHITECTURE

CROSS-REFERENCE TO RELATED APPLICATIONS

This application is a continuation of U.S. Ser. No. 13/968,379, filed Aug. 15, 2013; which claims benefit of priority with U.S. Provisional Ser. No. 61/683,675, filed Aug. 15, 2012; and relates to each of commonly owned:

U.S. Ser. No. 13/726,477, filed Dec. 24, 2012, now U.S. Pat. No. 8,648,755, issued Feb. 11, 2014, which is a continuation of U.S. Ser. No. 13/029,564, filed Feb. 17, 2011, now U.S. Pat. No. 8,362,962, issued Jan. 29, 2013, which is a continuation of U.S. Ser. No. 12/043,090, filed Mar. 5, 2008, now U.S. Pat. No. 7,911,402, issued Mar. 22, 2011, each titled "ANTENNA AND METHOD FOR STEERING ANTENNA BEAM DIRECTION";

U.S. Ser. No. 13/674,137, filed Nov. 12, 2012; which is a continuation in part of U.S. Ser. No. 13/227,361, filed Sep. 7, 2011, each titled "MODAL ANTENNA WITH CORRELATION MANAGEMENT FOR DIVERSITY APPLICATIONS"; and U.S. patent application Ser. No. 13/558,301, filed Jul. 25, 2012, titled "METHOD AND SYSTEM FOR SWITCHED COMBINED DIVERSITY WITH A MODAL ANTENNA", which claims benefit of U.S. Provisional Ser. No. 61/511,117, filed Jul. 25, 2011.

BACKGROUND OF THE INVENTION

Field of the Invention

This invention relates generally to the field of wireless communication. In particular, the invention relates to antennas and beam steering techniques capable of multi-frequency band operation and adapted for use in wireless communications.

Description of the Related Art

Current and future communication systems will require higher performance from the antenna systems. As new generations of handsets, gateways, and other wireless communication devices become embedded with more applications and the need for bandwidth becomes greater, new antenna systems will be required to optimize link quality over larger bandwidths. Specifically, better control of the radiated field from the antenna system will be required to provide better communication link quality for an antenna system tasked to cover a wide frequency range.

Antenna diversity systems are often used to improve the quality and reliability of a wireless communication link. In many instances, the line of sight between a transmitter and receiver becomes blocked or shadowed with obstacles such as walls and other objects. Each signal bounce may introduce phase shifts, time delays, attenuations, and distortions which ultimately interfere at the receiving antenna. Thus, destructive interference in the wireless link is often problematic and results in a reduction in device performance. Antenna diversity schemes can mitigate interference from multipath environments by providing multiple signal perspectives. Antenna diversity can be implemented generally in several forms, including: spatial diversity, pattern diversity and polarization diversity. Spatial diversity for reception generally includes multiple antennas having similar characteristics, which are physically spaced apart from one another. Pattern diversity generally includes two or more co-located antennas with distinct radiation patterns. This technique utilizes antennas that generate directive beams and are usually separated by a short distance. Polarization diversity generally includes paired antennas with orthogonal polarizations. Reflected signals can undergo polarization changes depending on the medium through which they are traveling. By pairing two complimentary polarizations, this scheme can immunize a system from polarization mismatches that would otherwise cause signal fade.

Commonly owned U.S. Pat. No. 7,911,402, issued Mar. 22, 2011, and titled "ANTENNA AND METHOD FOR STEERING ANTENNA BEAM DIRECTION", describes a beam steering technique wherein a single antenna is capable of generating multiple radiating modes; the contents of which are hereby incorporated by reference. In sum, this beam steering technique is effectuated with the use of a driven antenna and one or more offset parasitic elements that alter the current distribution on the driven antenna as the reactive load on the parasitic is varied. Multiple modes are generated, and thus this technique can be referred to as a "modal antenna technique", and an antenna configured to alter radiating modes in this fashion can be referred to as an "active multimode antenna" or "active modal antenna". An early application identified for this technique is a novel receive diversity application, wherein a single modal antenna can be configured to generate multiple radiating modes to provide a form of switched diversity. The benefits of this technique are the reduced volume required in the mobile device for a single antenna instead of a two antenna receive diversity scheme, reduction in receive ports on the transceiver from two to one, and the resultant reduction in current consumption from this reduction in receive ports.

An expansion of the switched diversity technique using a Modal antenna is to implement a two antenna receive diversity scheme such as an Maximum Ratio Combining (MRC) technique where one or both of the antennas are a Modal antenna. The additional radiation modes which result in additional radiation patterns generated by each Modal antenna will result in improved diversity gain.

Commonly owned U.S. Ser. No. 13/674,115, filed Nov. 12, 2012, and U.S. Ser. No. 13/749,627, filed Jan. 24, 3013, each describe a modal antenna or antennas used in a Multiple Input Multiple Output (MIMO) system to provide the capability to change the correlation coefficient between the pair of antennas dynamically. With 4G MIMO systems becoming more prevalent in the cellular communication field, the need for two or more antennas collocated in a mobile device are becoming more common. These groups of antennas in a MIMO system need to have high, and preferably, equal efficiencies along with high isolation and low correlation. For handheld mobile devices the problem is exacerbated by antenna detuning caused by the multiple use cases of a device: hand loading of the cell phone, cell phone placed to user's head, cell phone placed on metal surface, etc. For cell phone applications, the multipath environment is constantly changing, which impacts throughput performance of the communication link. A Modal antenna will provide the capability to compensate or alter the performance of the MIMO antenna pair as the environment changes.

As cellular networks become more heavily used and impacted by high data rates being accessed by a large number of users concurrently, a Modal antenna capable of generating multiple radiation patterns will provide system level improvements on both the transmit and receive function on mobile devices. A need for the Modal antenna capabilities at both transmit and receive frequency bands will complicate the design of the antenna system and will require attention be paid to the bandwidth that can be achieved for good correlation coefficient between the modes generated by the Modal antenna.

For a Modal antenna to provide improved communication system performance for either 3G or 4G systems it is important to provide an antenna capable of Modal operation at several frequency bands. U.S. patent application Ser. No. 13/227,361, titled "MODAL ANTENNA WITH CORRELATION MANAGEMENT FOR DIVERSITY APPLICATIONS" describes an antenna wherein multiple parasitic elements are proposed to provide the Modal antenna capability at several frequency bands. This technique provides the ability to optimize a parasitic element for a specific frequency band, with an additional parasitic element added to the antenna system when a second frequency band is required to possess the Modal antenna feature. This straight forward technique of adding or assigning a specific parasitic element for each frequency band required works well but requires additional volume for the additional parasitic elements and additional switches and reactive components to affect the loading of the parasitic elements. A method of providing the Modal antenna function at several frequency bands with a limited (ideally one) parasitic element is needed, along with a technique to dynamically alter the correlation coefficient bandwidth, to provide the ability to provide the Modal antenna function at transmit and/or receive frequency bands when desired without disturbing the performance of other frequency bands. Techniques and methods to address these issues are described in this patent.

SUMMARY OF THE INVENTION

An active antenna system developed to beam steer at multiple frequency bands provides improved performance for fixed and mobile communication systems. Methods of altering the current mode on a single radiator are described wherein the radiation pattern of the antenna is varied as the antenna modes are altered. Techniques to restrict or expand the frequency bandwidth of the beam steering technique are described to provide the capability to beam steer at receive frequencies or transmit frequencies only, and techniques are described where beam steering can occur at both transmit and receive frequency bands from a single active antenna system.

BRIEF DESCRIPTION OF THE DRAWINGS

FIG. 9A illustrates an active multi-mode antenna system including a single parallel LC circuit coupled to an offset parasitic element positioned in proximity to an antenna radiating element.

FIG. 9B shows a graph of the phase of the reactance for both low and high Q tuning configurations.

FIG. 9C shows a graph of correlation coefficient as a function of frequency for both low and high Q tuning configurations.

FIG. 12A illustrates an L-shaped parasitic element configured to alter the radiation modes at two separate frequency bands.

FIGS. 12(B-C) show graphs of efficiency and correlation for two modes of an active multi-mode antenna system at the 900 MHz, and 1900 MHz cellular bands, respectfully.

DETAILED DESCRIPTION OF EMBODIMENTS

Figure 1A:
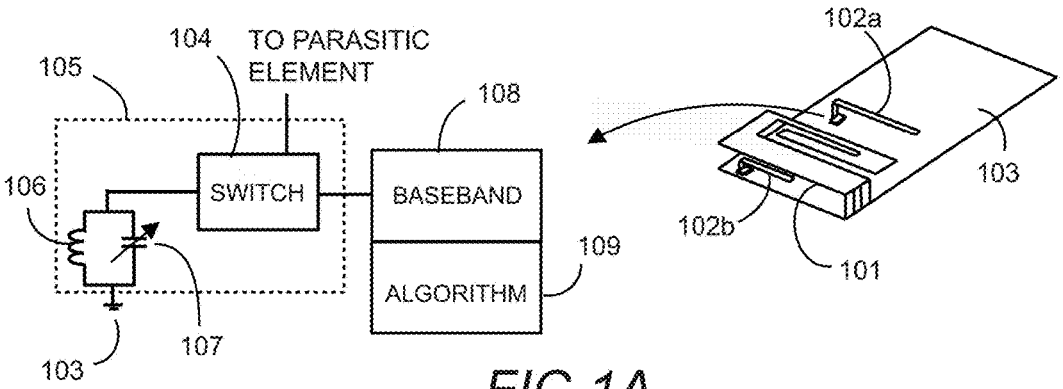
FIG. 1A shows an active multi-mode antenna system configured to dynamically adjust the antenna mode and thereby alter the correlation coefficient.

An active multi-mode antenna system, otherwise known as a "Modal Antenna", provides the capability to beam steer across multiple frequency bands as well as dynamically adjust the correlation coefficient bandwidth between radiation modes generated by the Modal antenna system. A combination of these attributes will provide for the functionality and optimization required for a Modal antenna system to service multiple frequency bands in the cellular spectrum as well as provide the ability to provide beam steering capability at transmit band only, receive band only, or at both transmit and receive bands for Frequency Division Duplex (FDD) applications. Use of fast switching and tunable components configured in unique topologies provide the capability to dynamically configure the Modal antenna for the frequency band of interest during operation of the mobile communication device.

In one embodiment of the invention, a parasitic element is designed and shaped in a fashion to alter the current mode on the driven antenna element at multiple resonances or frequency bands. Sections of the parasitic element are dimensioned and oriented to optimize for a specific frequency band. A common parasitic element can be designed to drive a Modal antenna at multiple resonances of the main antenna. This use of a common parasitic element for multiple frequency bands results in reduced volume within the device required for the parasitic element, along with less active and passive components required to activate the parasitic element. Complexity in control signaling is reduced when a single parasitic element can be used for multiple frequency bands.

In another embodiment of the invention, one portion of the parasitic element is integrated into the PCB (Printed Circuit Board) of the host device. This is achieved by designing a microstrip transmission line to replace one section of the parasitic element. The electrical length of the microstrip line is selected to simulate the electrical length of the section of the parasitic element that is being replaced. This technique provides additional flexibility in regards to integration of a Modal antenna into a host device, since a portion of the parasitic element can be designed into an existing PCB.

In another embodiment of the invention, LC circuits are attached to one end of the parasitic element, with the other end of the LC circuit attached to ground. The resonant frequency and Q of the LC circuit is chosen to interact with the reactance of the parasitic element to increase or decrease the correlation bandwidth between the fundamental mode, mode 0, of the Modal antenna and the mode generated when the LC circuit is used to connect the parasitic element to ground. An increase in Q of the LC circuit results in a decrease in correlation bandwidth between mode 0 and the mode formed when the LC circuit connects the parasitic element to ground. Alternately, a decrease in Q of the LC circuit results in an increase in correlation bandwidth between mode 0 and the mode formed when the LC circuit connects the parasitic element to ground. This technique wherein the correlation bandwidth can be altered provides the capability to generate a Modal antenna where multiple radiation patterns can be formed from a single Modal antenna at the receive frequency band, transmit frequency band, or both transmit and receive frequency bands of one or multiple communication bands. This provides the flexibility to form multiple radiation patterns at the receive frequency band for a receive diversity application, without altering the radiation patterns at the transmit frequency band. This is an important feature since the propagation characteristics of a communication channel vary as a function of frequency. The optimal radiation mode for a receive frequency channel might not be optimal for a transmit frequency channel based upon propagation channel characteristics, so it is important to generate radiation modes at one frequency band but not additional frequency bands. This can be achieved by limiting the correlation bandwidth of the Modal antenna. One implementation of this technique is to use a single pole, single throw switch to connect or disconnect the LC circuit to the parasitic element. This configuration will provide the open circuit condition and the LC loading condition for the parasitic element to generate the two radiation modes from the antenna element.

In another embodiment of the invention, a tunable or variable inductor and a tunable or variable capacitor are used in conjunction to form an LC circuit. The tunable inductor and tunable capacitor provide an LC series or parallel circuit wherein the Q can be varied while maintaining the resonant frequency. This tunable LC circuit, when attached to the parasitic element of a Modal antenna provides the capability to alter the correlation bandwidth between modes of the Modal antenna by adjusting the inductance and capacitance of the LC circuit. Alternately, either the inductance or capacitance of the LC circuit can be altered such that the resonant frequency of the LC circuit attached to the parasitic element varies. This variation in reactance will result in a shift in the frequency response of the Modal antenna to provide an active antenna capable of generating multiple radiation modes from a single antenna element over a wide frequency range.

Those skilled in the art will appreciate that various embodiments discussed above, or parts thereof, may be combined in a variety of ways to create further embodiments that are encompassed by the present invention.

Figure 1B:
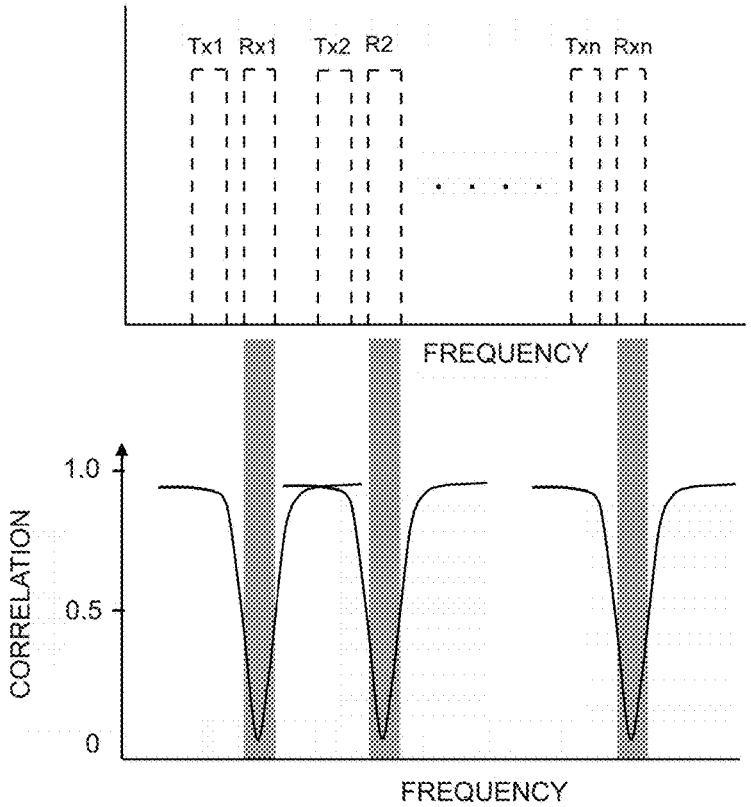
FIG. 1B shows the antenna correlation at various frequency bands in accordance with the antenna system of FIG. 1A.

Now turning to the drawings, FIG. 1A illustrates a Modal antenna system where the correlation coefficient between modes can be dynamically adjusted. Here, the Modal antenna system includes a radiating element 101 positioned above a circuit board forming an antenna volume therebetween, a first parasitic element 102*b* positioned within the antenna volume, and a second parasitic element 102*a* positioned adjacent to the antenna radiating element and offset therefrom. An antenna tuning module (ATM) 105 containing a switch 104 and tunable LC circuit (including inductor 106 and tunable capacitor 107) is controlled by a baseband processor 108 and algorithm 109 associated therewith. The ATM is coupled to a parasitic element 102*a* which is in turn coupled to an antenna radiating element 101. The correlation coefficient between modes, as shown in FIG. 1B, is minimized at receive band frequencies for multiple frequency bands.

Figure 2:
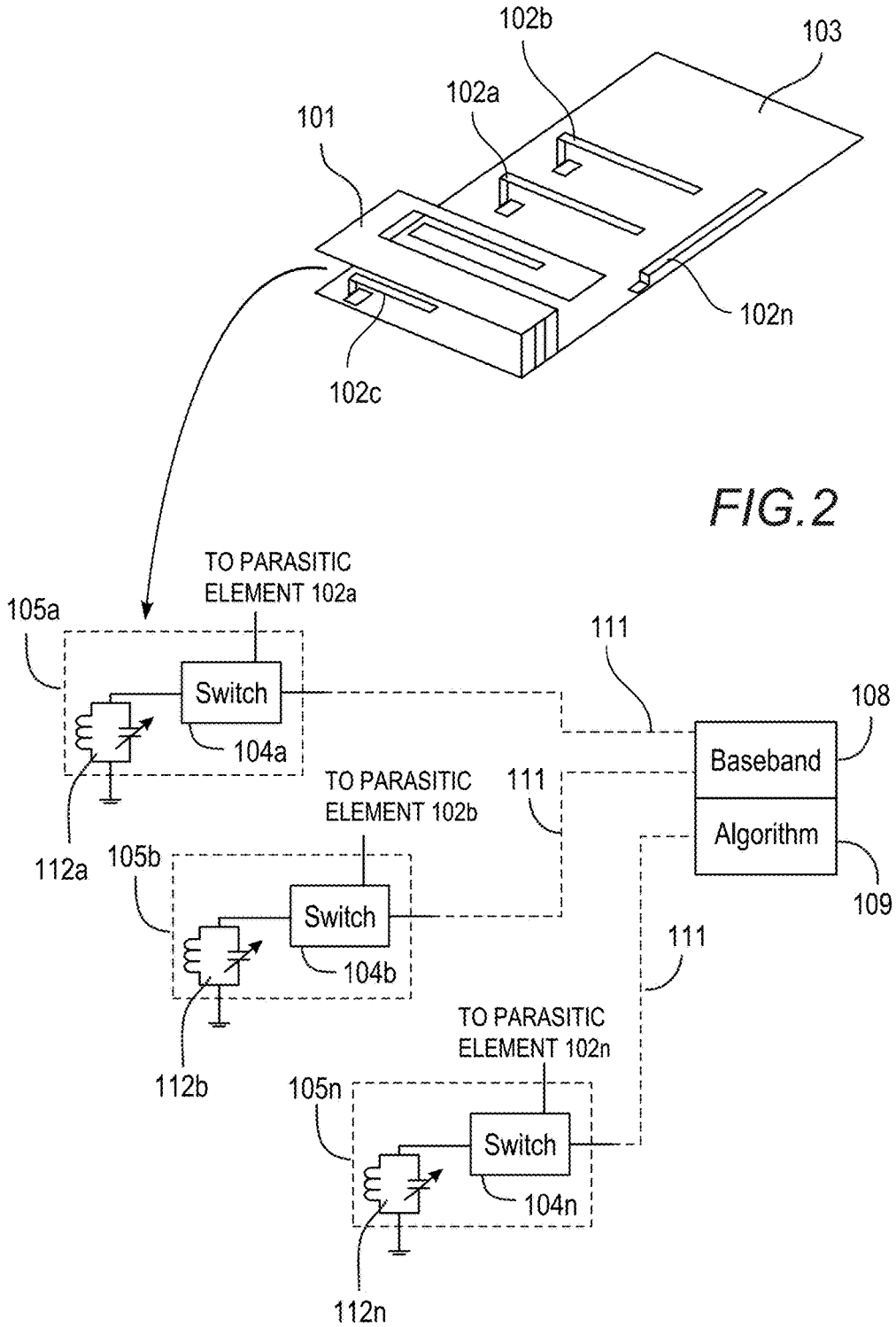
FIG. 2 shows an active multi-mode antenna system including a radiating element and a plurality of parasitic elements offset from the radiating element, the parasitic elements are configured to dynamically alter the correlation coefficient between modes of the active multi-mode antenna system.
Figure 3A:
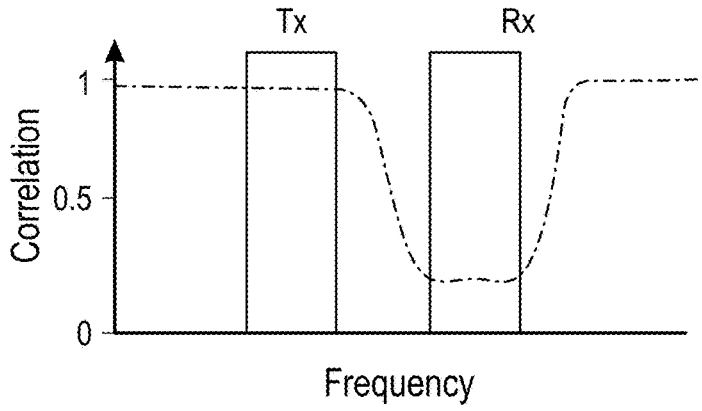
FIGS. 3(A-D) illustrate how dynamic altering of correlation coefficient can be used in FDD (Frequency Division Duplex) and TDD (Time Division Duplex) protocols to provide low correlation between modes at the receive bands, transmit bands, or both receive and transmit bands.
Figure 3B:
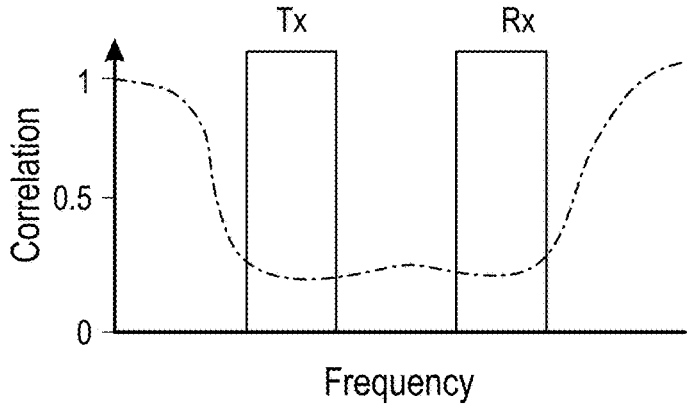
Figure 3C:
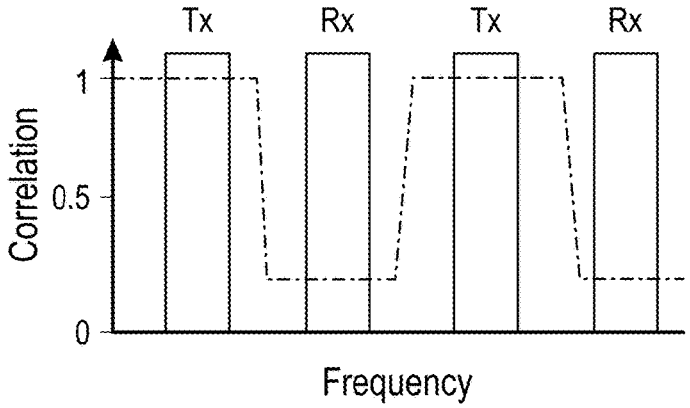
Figure 3D:
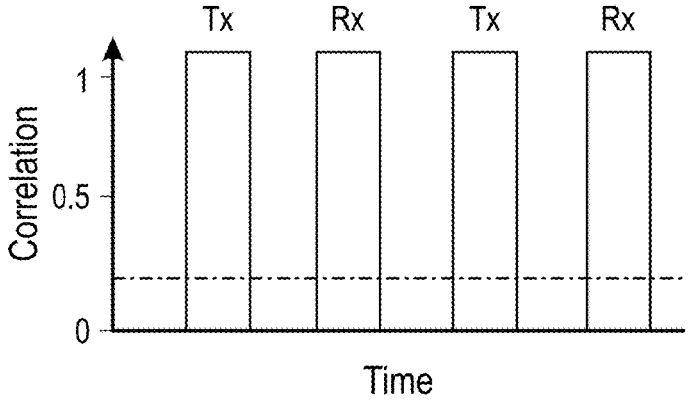

FIG. 2 illustrates a Modal antenna system containing multiple offset parasitic elements (102*a*; 102*b*; 102*c*; . . . ; 102*n*) positioned next to antenna radiating element 101 are used to dynamically alter the correlation coefficient between modes of the antenna system. An antenna tuning module (ATM) 105*a*; 105*b*; and 105*c* each containing a switch 102*a*; 102*b*; 102*c*, respectively and tunable LC circuit 112*a*; 112*b*; and 112*c*, respectively, is coupled to each parasitic element, with the ATMs being controlled by an algorithm 109 resident in a baseband processor 108.

FIGS. 3(A-D) illustrate how dynamic altering of correlation coefficient can be used in FDD (Frequency Division Duplex) and TDD (Time Division Duplex) protocols to provide low correlation between Modes at the receive bands, transmit, bands, or both bands. In the first graph, FIG. 3A, the correlation in the receive band of an FDD system is reduced while maintaining a high correlation between modes at the transmit band. In the second graph, FIG. 3B, correlation in both transmit and receive bands of an FDD system is minimized. In the third graph, FIG. 3C, the correlation in the receive band of a TDD system is reduced while maintaining a high correlation between modes at the transmit band. In the fourth graph, FIG. 3D, correlation in both transmit and receive bands of a TDD system is minimized.

Figure 4:
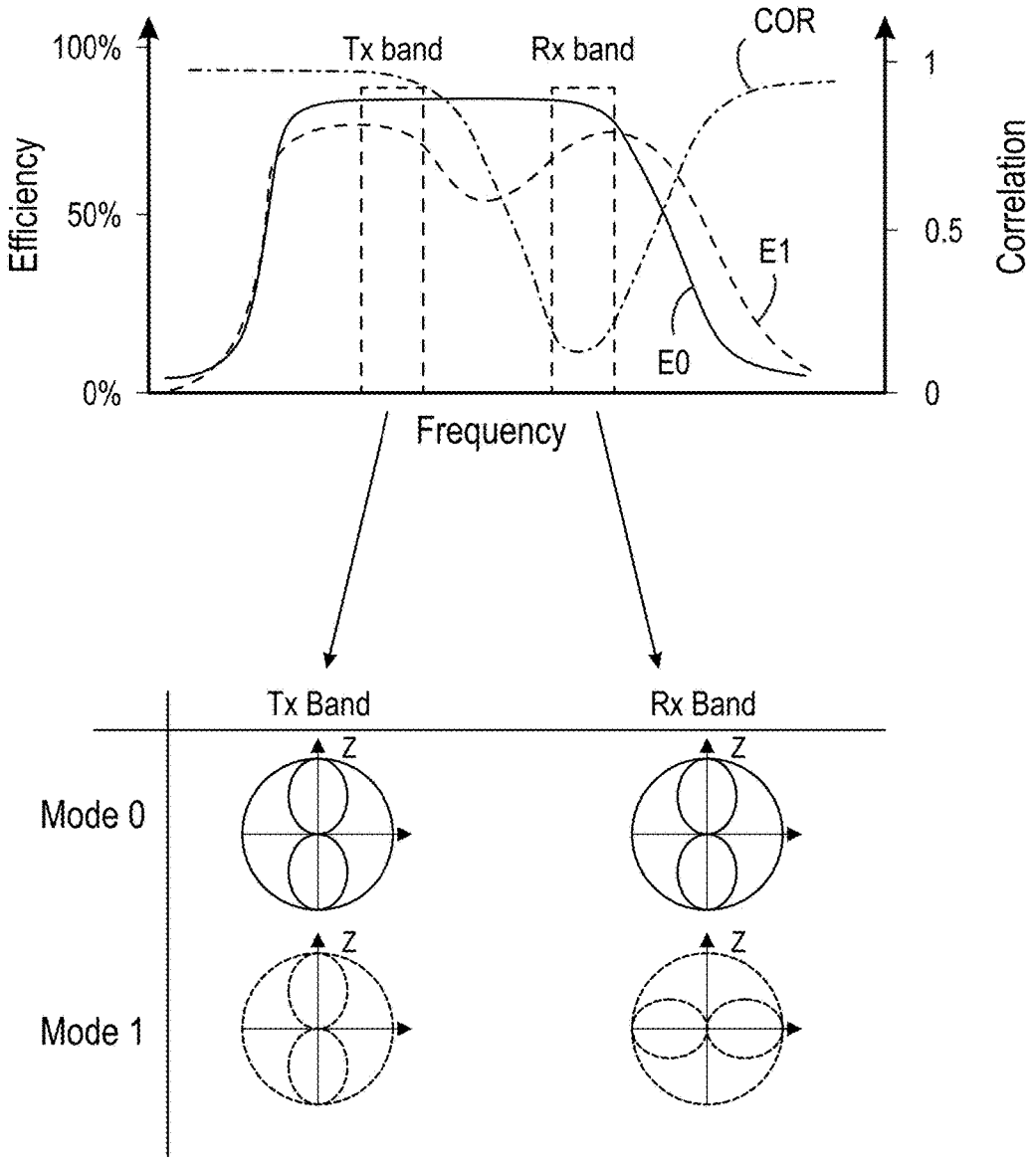
FIG. 4 illustrates the efficiency of two modes from an active multi-mode antenna system plotted along with the correlation between the two modes; the antenna system has low correlation at the receive band while maintaining high correlation at the transmit band.

FIG. 4 shows a graph where the efficiency of two modes (E0, E1) from a Modal antenna are plotted along with the correlation (COR) between the two modes. The Modal antenna has low correlation at the receive frequency band while maintaining high correlation at the transmit frequency band. Radiation patterns at both transmit and receive frequency bands are shown to illustrate the change in radiation patterns that occur when the correlation is low.

Figure 5:
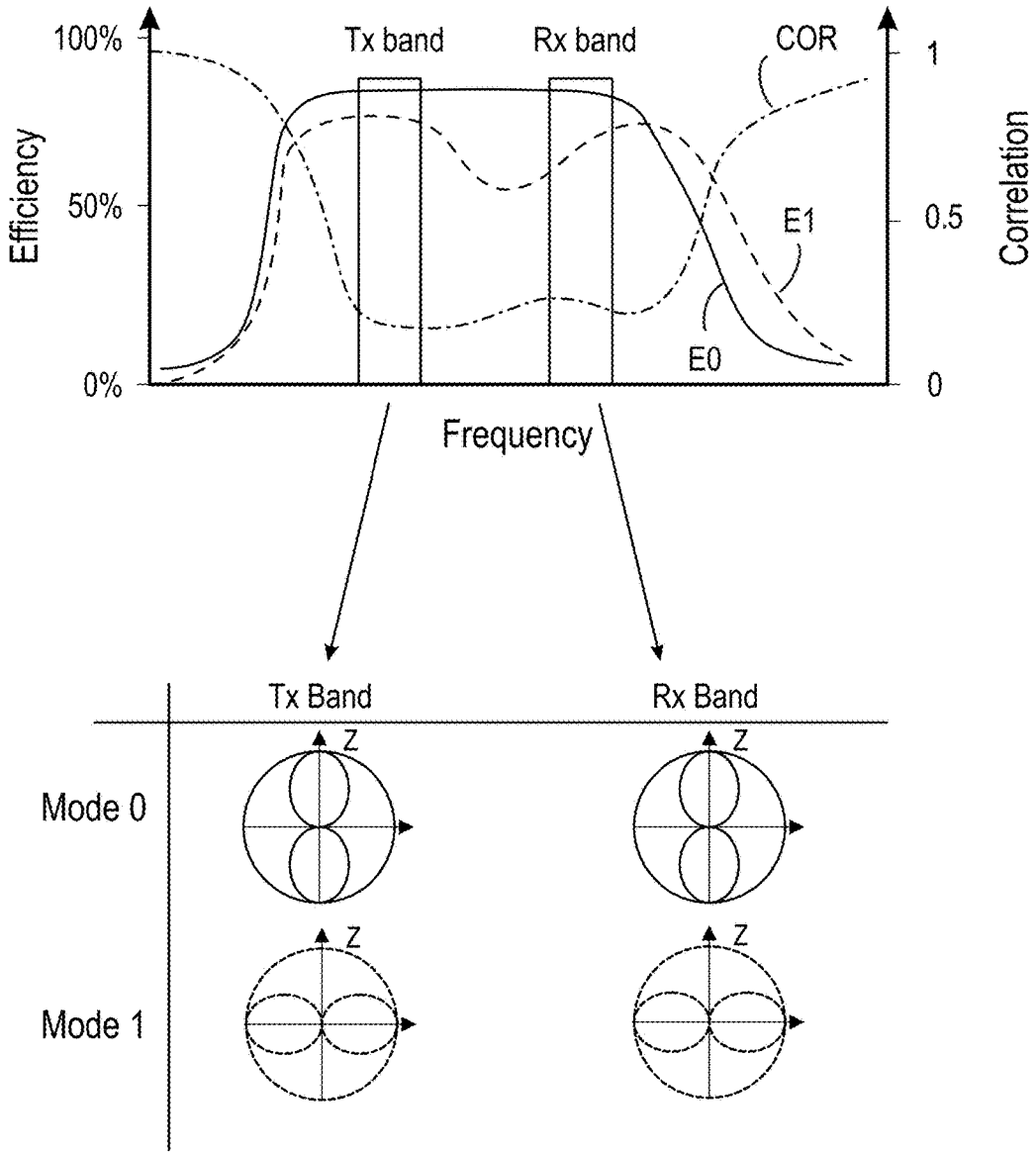
FIG. 5 illustrates the efficiency of two modes from an active multi-mode antenna system plotted along with the correlation between the two modes; the antenna system has low correlation at both the receive and transmit bands.

FIG. 5 shows a graph where the efficiency of two modes (E0, E1) from a Modal antenna are plotted along with the correlation (COR) between the two modes. The Modal antenna has low correlation at both transmit and receive frequency bands. Radiation patterns at both transmit and receive frequency bands are shown to illustrate the change in radiation patterns that occur when the correlation is low.

Figure 6:
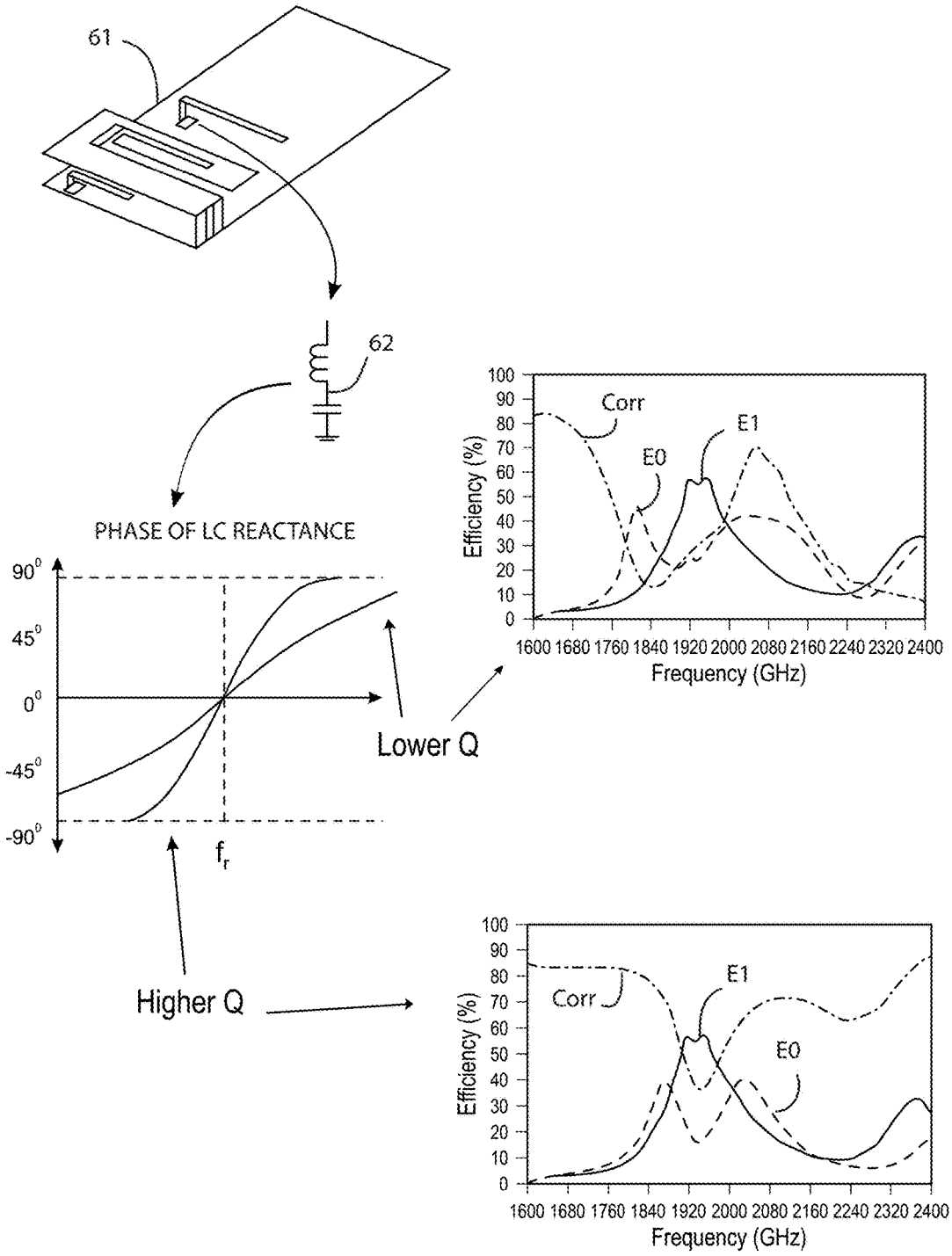
FIG. 6 illustrates an active multi-mode antenna system including a series LC circuit coupled to an offset parasitic element that is positioned in proximity to an antenna radiating element, along with changes in resulting antenna correlation.

FIG. 6 illustrates a Modal antenna system where a series LC circuit 62 is coupled to an offset parasitic positioned in proximity to an antenna. A graph of the phase of the reactance of the LC circuit is shown for both Lower Q and higher Q LC circuits. The lower Q LC circuit coupled to the offset parasitic element results in a low correlation between Modes over a wider frequency band compared to a higher Q LC circuit, as can be seen in the plots of efficiency E0; E1 and correlation (Corr) for both a lower Q and higher Q case.

Figure 7A:
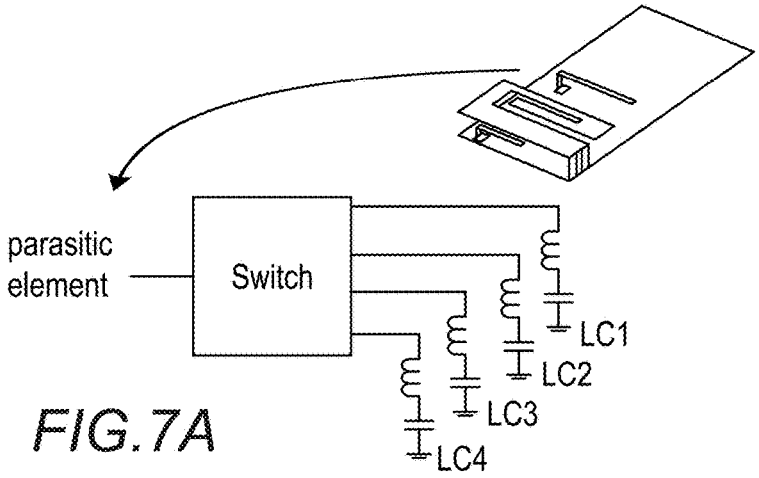
FIG. 7A illustrates an active multi-mode antenna system including four series LC circuits and a switch coupled to an offset parasitic positioned in proximity to an antenna radiating element.
Figure 7B:
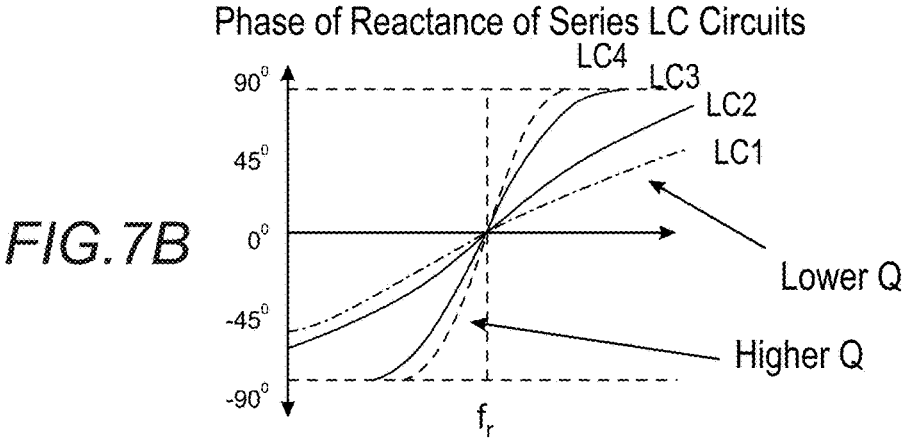
FIG. 7B shows a graph of the phase of the reactance of the four LC circuits.
Figure 7C:
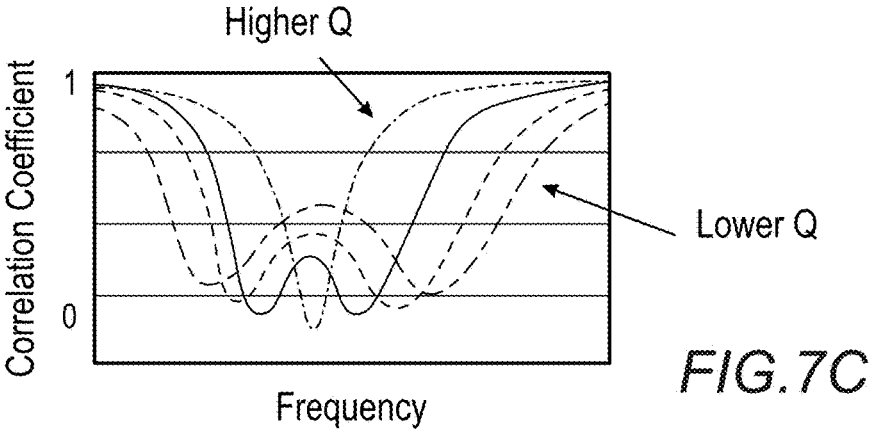
FIG. 7C shows a graph of correlation coefficient as a function of frequency shown for the four LC circuits coupled to the parasitic element of FIG. 7A.

FIG. 7A illustrates a Modal antenna system where four series LC circuits LC1; LC2; LC3; and LC4 are coupled to an offset parasitic element positioned in proximity to an antenna radiating element. A multi-port switch is used to select an LC circuit to the parasitic element. In FIG. 7B, a graph of the phase of the reactance of the four LC circuits is shown. In FIG. 7C, a graph of correlation coefficient as a function of frequency is shown for the four LC circuits coupled to the parasitic element. The correlation bandwidth varies as a function of Q of the LC circuit.

Figure 8A:
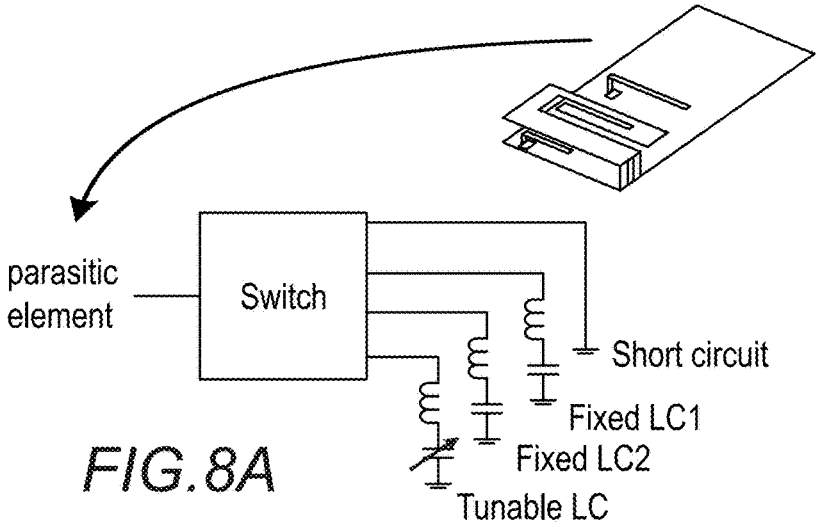
FIG. 8A illustrates an active multi-mode antenna system including a multi-port switch configured to couple four different circuits to an offset parasitic element of a antenna system.
Figure 8B:
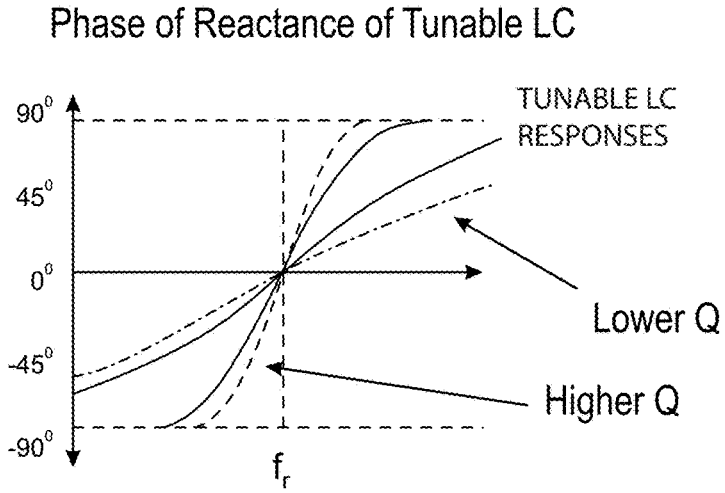
FIG. 8B shows a graph of the phase of the reactance for multiple tuning configurations of the tunable circuit.
Figure 8C:
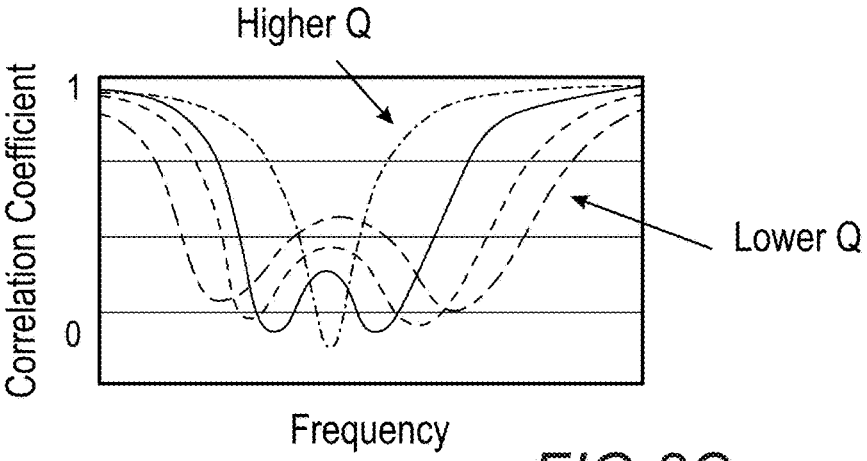
FIG. 8C shows a graph of correlation coefficient as a function of frequency shown for multiple tuning configurations of the tunable LC circuit coupled to the parasitic element according to FIG. 8A.

FIG. 8A illustrates a Modal antenna system where a multi-port switch is used to couple four different circuits to the offset parasitic element of a Modal antenna system. A short circuit, fixed LC circuit 1, fixed LC circuit 2, and a tunable LC circuit where both the inductor and capacitor can be varied are connected to ports of the multi-port switch. In FIG. 8B, a graph of the phase of the reactance for multiple tuning configurations of the tunable circuit is shown. In FIG. 8C, a graph of correlation coefficient as a function of frequency is shown for multiple tuning configurations of the tunable LC circuit coupled to the parasitic element. The correlation bandwidth varies as a function of Q of the LC circuit.

FIG. 9A illustrates a Modal antenna system where a single parallel LC circuit is coupled to an offset parasitic element positioned in proximity to an antenna radiating element. A switch is used to connect or disconnect the parallel LC circuit to the parasitic element. FIG. 9B shows a graph of the phase of the reactance of for both low and high Q tuning configurations. FIG. 9C shows a graph of correlation coefficient as a function of frequency for both low and high Q tuning configurations is shown. The correlation bandwidth varies as a function of Q of the LC circuit.

Figure 10A:
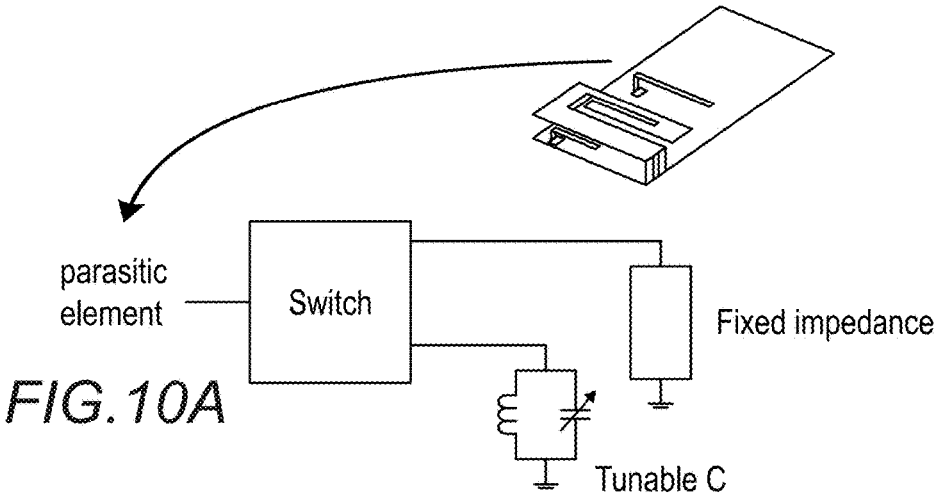
FIG. 10A illustrates an active multi-mode antenna system where a parallel LC circuit and a fixed impedance are coupled to an offset parasitic element positioned in proximity to an antenna radiating element.
Figure 10B:
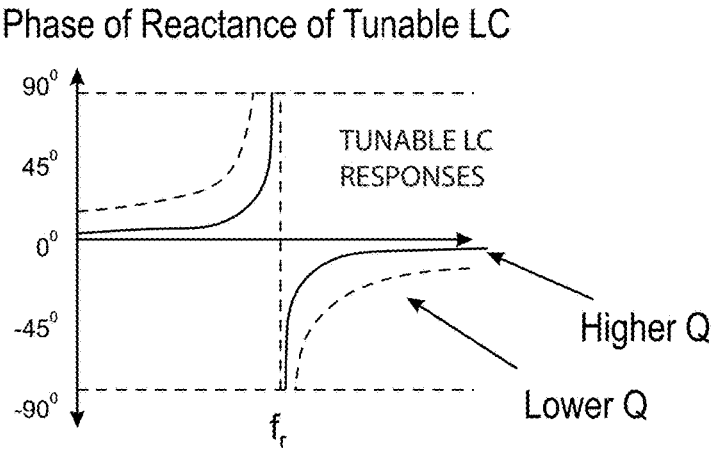
FIG. 10B shows a graph of the phase of the reactance of for both low and high Q tuning configurations of the tunable parallel circuit.
Figure 10C:
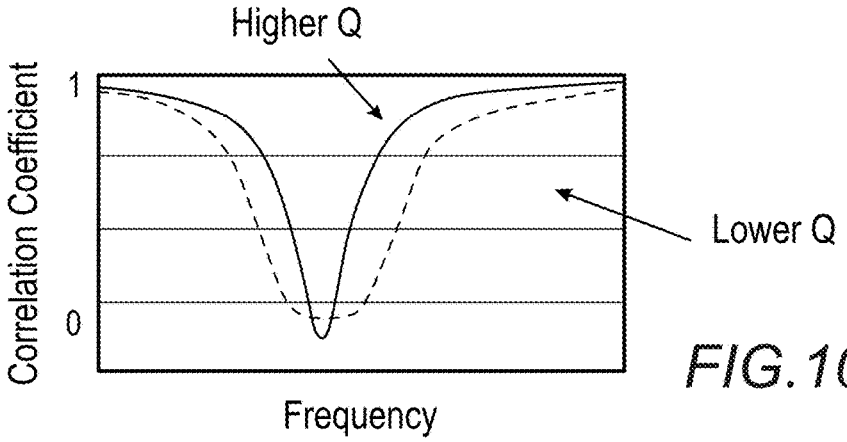
FIG. 10C shows a graph of correlation coefficient as a function of frequency for both low and high Q tuning configurations of the tunable parallel circuit.

FIG. 10A illustrates a Modal antenna system where a parallel LC circuit and a fixed impedance are coupled to an offset parasitic element positioned in proximity to an antenna radiating element. A switch is used to select the circuit to connect to the parasitic element. FIG. 10B shows a graph of the phase of the reactance of for both low and high Q tuning configurations of the tunable parallel circuit. FIG. 10C shows a graph of correlation coefficient as a function of frequency for both low and high Q tuning configurations of the tunable parallel circuit is shown. The correlation bandwidth varies as a function of Q of the LC circuit.

Figure 11:
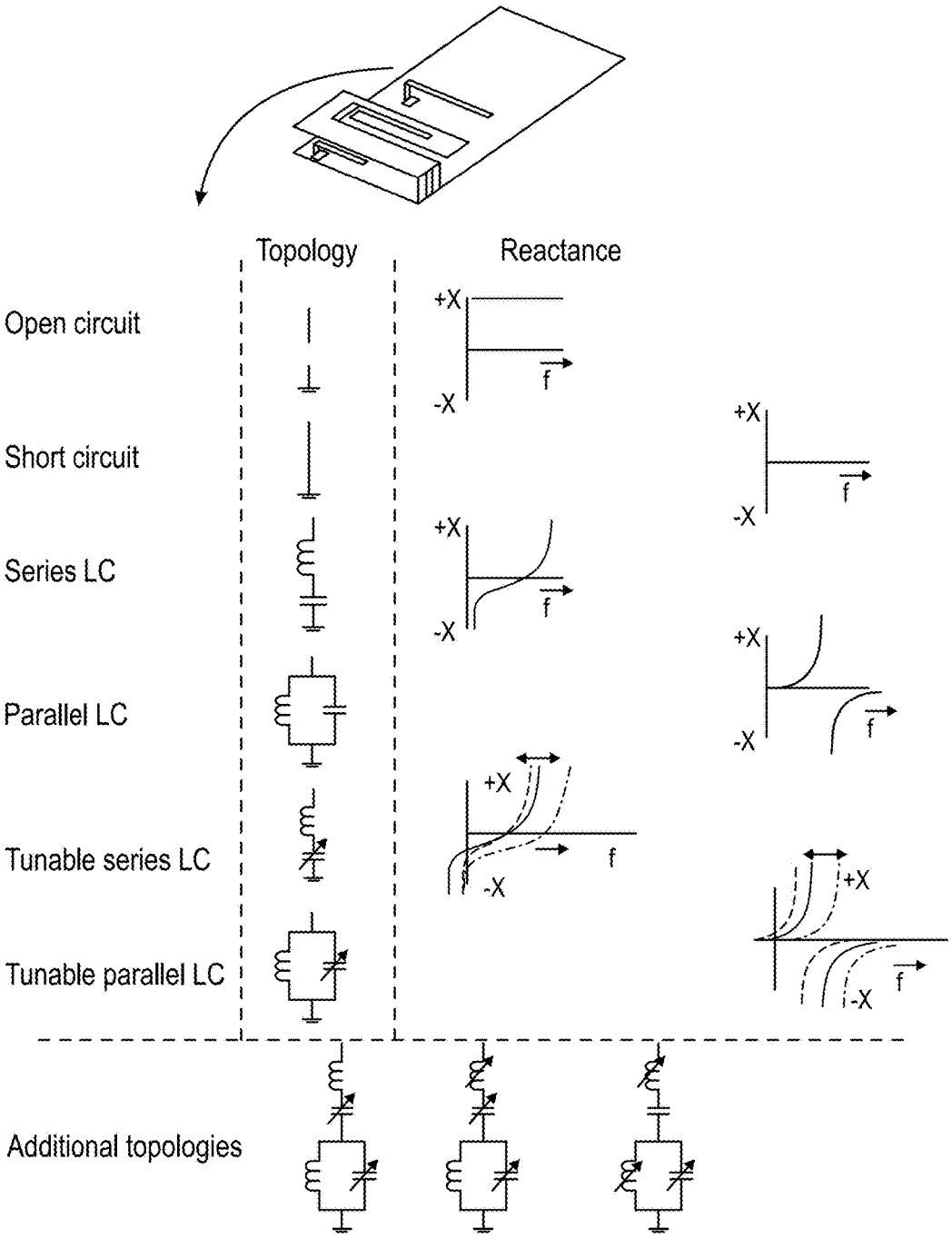
FIG. 11 illustrates topologies that can be used to couple to a parasitic element for reactive loading purposes.

FIG. 11 illustrates topologies that can be used to couple to a parasitic element for reactive loading purposes.

FIG. 12A illustrates an L-shaped parasitic element 125 configured to alter the radiation modes at two separate frequency bands. The L-shaped parasitic element 124 is coupled to an active tuning component 126 and positioned adjacent to an antenna radiating element 122. The radiating element is further disposed above a circuit board 121 forming an antenna volume therebetween, wherein a first parasitic element 123 is positioned beneath the radiating element within the antenna volume, and the first parasitic element 123 is further coupled to a first active tuning component 124. Graphs of efficiency and correlation for two modes of a Modal antenna at the 900 MHz and 1900 MHz cellular bands are shown in FIGS. 12B-12C, respectively.

Figure 13:
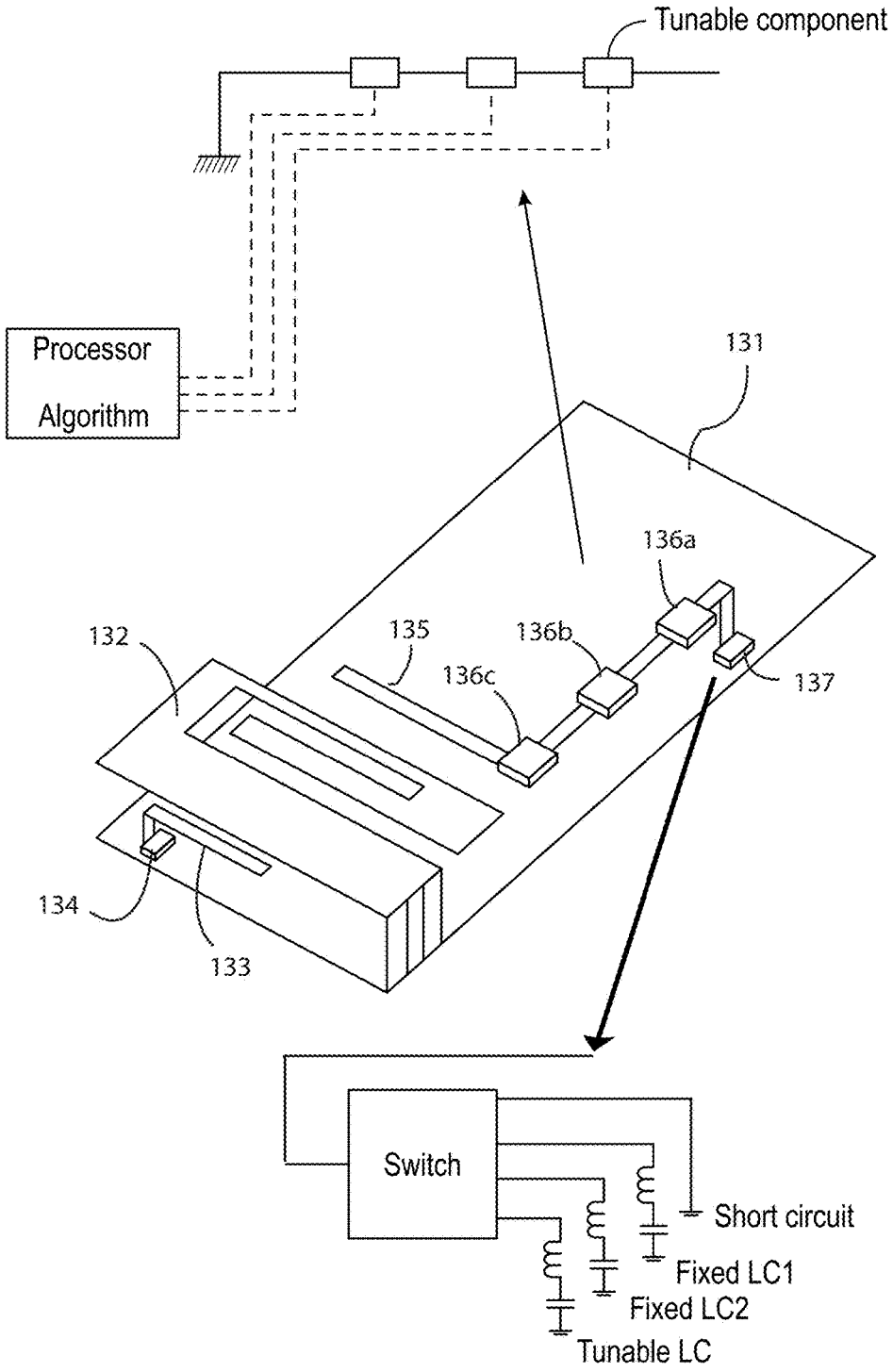
FIG. 13 illustrates a single L-shaped offset parasitic element configured to alter the radiation modes at multiple frequency bands.

FIG. 13 illustrates a single L-shaped offset parasitic element 135 configured to alter the radiation modes at multiple frequency bands. In addition to the L-shaped parasitic element 135, the antenna system includes radiating element 132 positioned above circuit board 131 forming antenna volume therebetween, and first parasitic element 133 is positioned beneath the radiating element 132 within the antenna volume, and is coupled to active tuning component 134. Tunable components 136*a*; 136*b*; 136*c* are connected to or coupled to portions of the L-shaped parasitic element, with these tunable components being used to reactively load the parasitic element and/or connect or disconnect portions of the parasitic element from the remainder of the L-shaped parasitic element. An algorithm resident in a processor is used to control the various tunable components. A multi-port switch 137 is shown with four circuits attached to the ports: a short circuit, fixed LC circuit 1, fixed LC circuit 2, and a tunable LC circuit where both the inductor and capacitor can be varied.

Figure 14A:
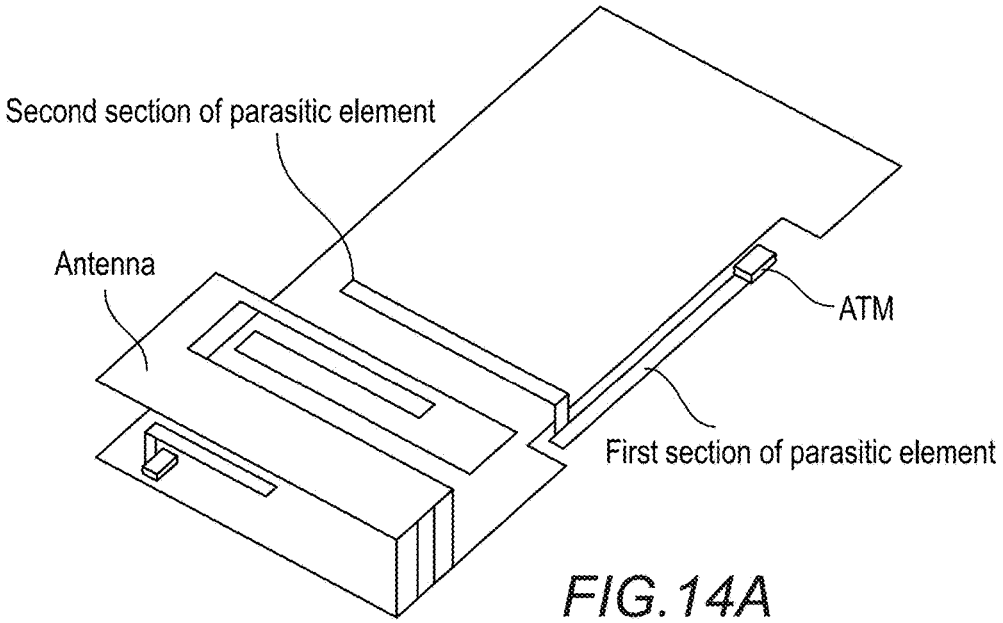
FIG. 14A illustrates a single offset parasitic element configured to alter the radiation modes at two separate frequency bands.
Figure 14B:
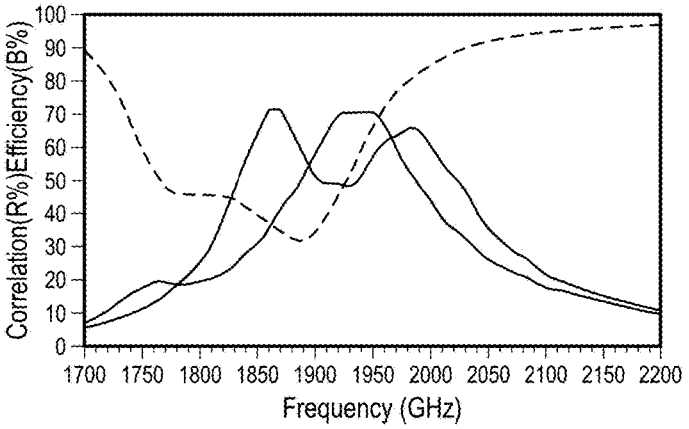
FIG. 14B shows the antenna correlation of the antenna shown in FIG. 14A.

FIG. 14A illustrates a single offset parasitic element configured to alter the radiation modes at two separate frequency bands. The section of the parasitic element connected to the ATM is formed by using a transmission line, with this transmission line connected to a second section formed by a conductor which is positioned in proximity to an antenna. The antenna correlation is shown in FIG. 14B.

Figure 15:
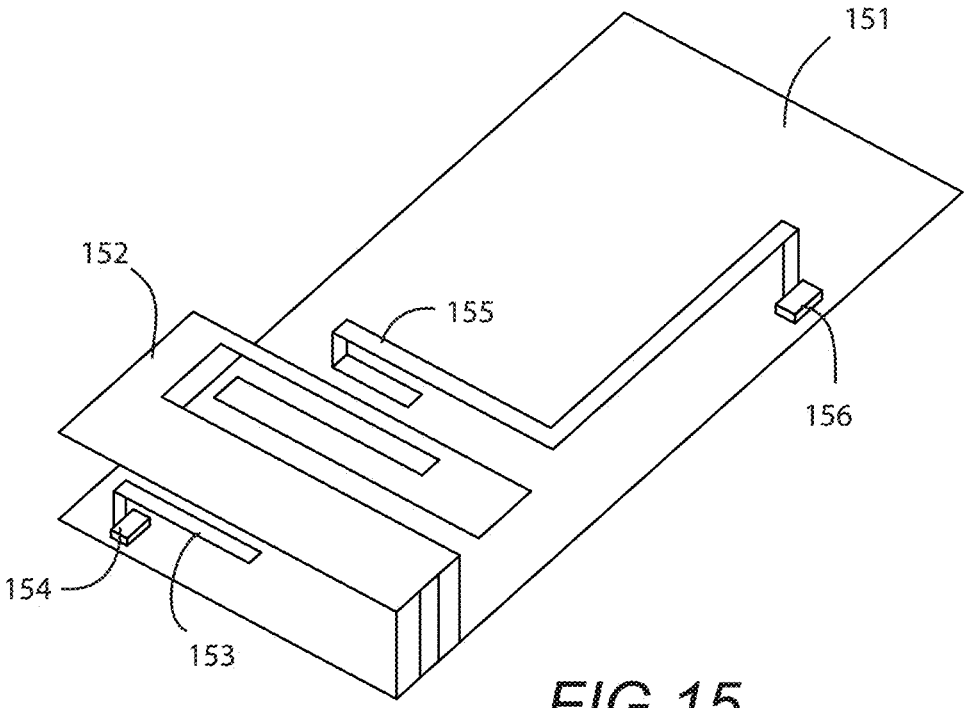
FIG. 15 illustrates a single L-shaped offset parasitic element configured to alter the radiation modes at two separate frequency bands.

FIG. 15 illustrates a single L-shaped offset parasitic element 155 configured to alter the radiation modes at two separate frequency bands. The parasitic element 155 is folded back under itself at a terminal end to make the design more volume efficient. IN addition to the L-shaped parasitic element, the antenna system includes a radiating element 152 positioned above circuit board 151 forming an antenna volume therebetween, and a first parasitic element 153 positioned beneath the radiating element 152 within the antenna volume, wherein the first parasitic element 153 is coupled to active tuning component 154.

Figure 16A:
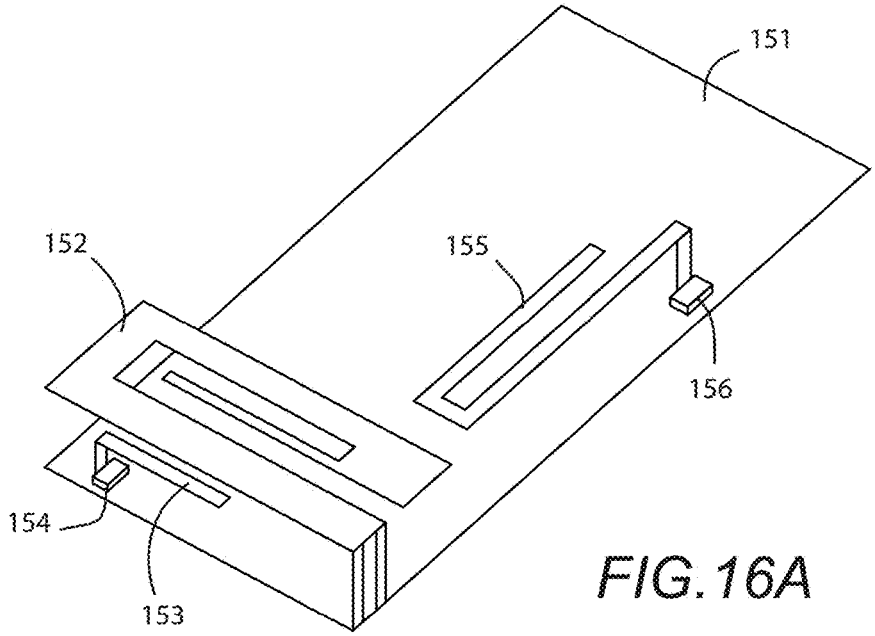
FIG. 16A illustrates an antenna with a single offset parasitic element configured to alter the radiation modes at a lower frequency band without altering the radiation modes at higher frequency bands.
Figure 16B:
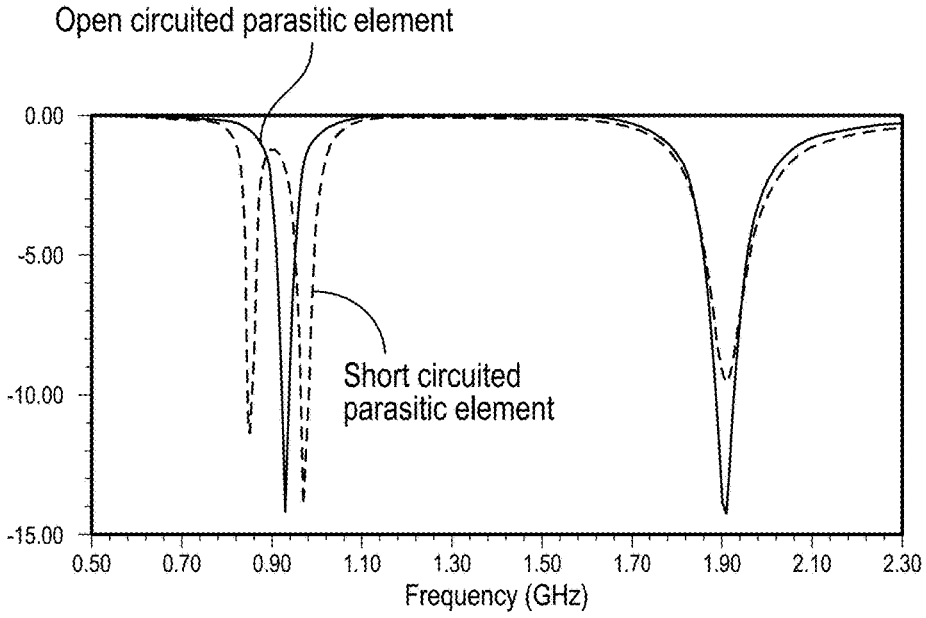
FIG. 16B shows a graph including the return losses of the active multi-mode antenna system for both open and short circuited condition on the offset parasitic element.
Figure 17A:
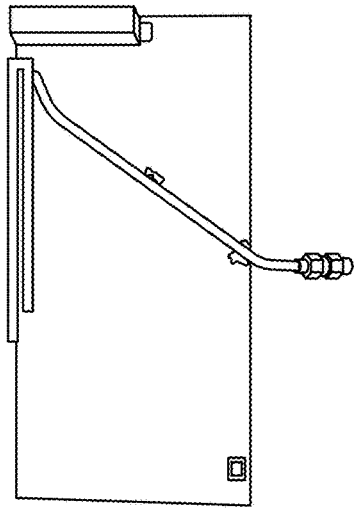
FIGS. 17(A-E) illustrate various multi-frequency band parasitic elements that can be used to generate multiple modes in an active multi-mode antenna system configuration.
Figure 17B:
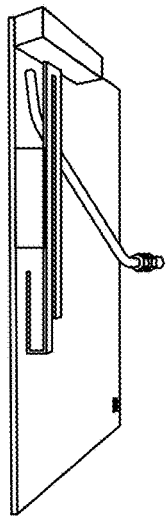
Figure 17C:
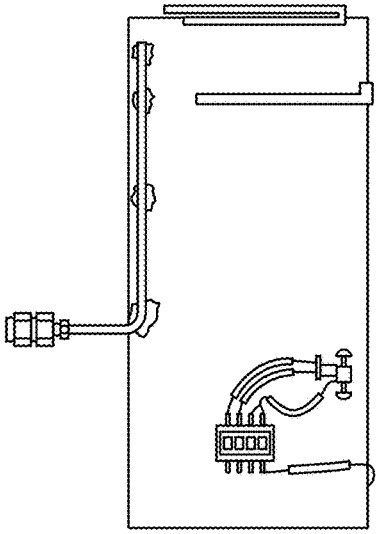
Figure 17D:
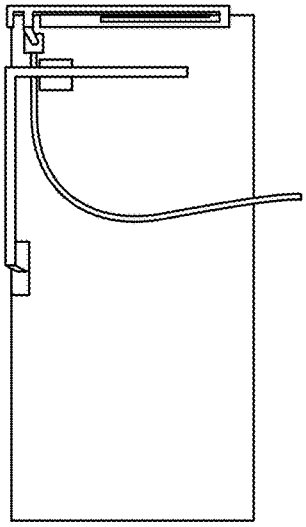
Figure 17E:
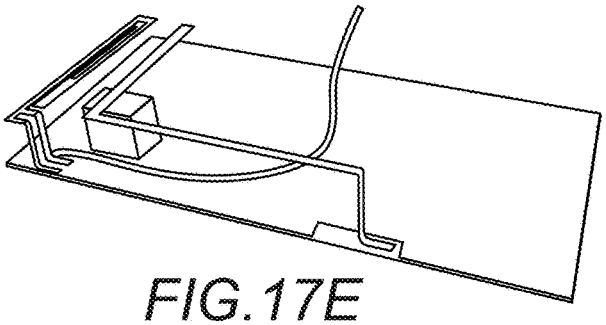

FIG. 16A illustrates an antenna system with a single offset parasitic element 155 configured to alter the radiation modes at a lower frequency band without altering the radiation modes at higher frequency bands. A graph is shown in FIG. 16B where the return losses of the Modal antenna for both open and short circuited condition on the offset parasitic is included.

FIGS. 17(A-E) illustrate various multi-frequency band parasitic elements that can be used to generate multiple modes in Modal antenna configurations.

The invention claimed is:

1. An antenna comprising:

a first antenna element positioned above a ground plane and forming an antenna volume therebetween;

a first parasitic element positioned outside of the antenna volume and adjacent to said first antenna element;

a first LC circuit associated with the first parasitic element, the first LC circuit comprising at least one inductor and at least one capacitor; and a switch configured to connect the first parasitic element to a first end of the first LC circuit, the first LC circuit being further connected to ground;

further characterized in that said first parasitic element comprises:

a first portion and a second portion, the first portion being oriented parallel with respect to the first antenna element, the second portion being oriented perpendicular with respect to the first antenna element, the first portion being coupled to the second portion of the first parasitic element.

2. The antenna of claim 1, wherein the switch connected to the first parasitic element is a two-port switch.

3. The antenna of claim 1, wherein the switch connected to the first parasitic element comprises three or more ports.

4. The antenna of claim 3, wherein the switch is coupled to a distinct inductor and a distinct capacitor at each of said three or more ports.

5. The antenna of claim 1:

wherein:

when the switch is in the open circuit state radiation mode 0 is attained, when the switch is in the short circuit state the LC circuit is connected to the first parasitic element and radiation mode 1 is attained; and wherein a Q factor of the LC circuit can be selected to alter the frequency bandwidth of the correlation coefficient between radiation modes 0 and 1.

6. The antenna of claim 1, said switch further coupled to a processor and configured to receive baseband signals for configuring the first parasitic element.

7. The antenna of claim 1, further comprising:

a second parasitic element positioned outside of the antenna volume and adjacent to said first antenna element;

a second LC circuit associated with the second parasitic element, the second LC circuit comprising at least one second inductor and at least one second capacitor; and a second switch configured to connect the second parasitic element to a first end of the second LC circuit, the second LC circuit further connected to ground at a second end thereof opposite of the first end.

8. The antenna of claim 7, each of said switches being further coupled to a processor and configured to receive baseband signals for configuring the respective parasitic element.

9. The antenna of claim 1, wherein said first LC circuit comprises a series LC circuit.

10. The antenna of claim 9, wherein said series LC circuit comprises a tunable capacitor forming a tunable series LC circuit.

11. The antenna of claim 1, wherein said first LC circuit comprises a parallel LC circuit.

12. The antenna of claim 11, wherein said first LC circuit comprises a tunable capacitor forming a tunable parallel LC circuit.

13. The antenna of claim 1, said first parasitic element comprising a tunable component positioned between the first and second portions thereof, the tunable component coupled to a processor for receiving control signals therefrom, the tunable component being configured to selectively couple and decouple the first and second portions of the first parasitic element.

14. The antenna of claim 13, the first parasitic element comprising three or more portions and two or more tunable components, wherein each of the two or more tunable components is configured to selectively couple and decouple two adjacent portions of the first parasitic element.

15. The antenna of claim 1, wherein the first portion of the first parasitic element is adapted to provide a first split resonant frequency characteristic associated with said first antenna element.

16. The antenna of claim 15, wherein the second portion of the first parasitic element is adapted to provide a second split resonant frequency characteristic associated with said first antenna element, the second split resonant frequency characteristic occurring at a different frequency than the first split resonant frequency characteristic of the first portion of the first parasitic.

17. The antenna of claim 16, wherein the second portion of the first parasitic element comprises a microstrip line formed in the ground plane.

18. The antenna of claim 16, wherein the second portion of the first parasitic element comprises a transmission line, the transmission line including one or more of: a coaxial transmission line, parallel wire transmission line, stripline transmission line, lumped component representation of a transmission line, or co-planar waveguide transmission line.

19. The antenna of claim 1, said first parasitic element being coupled to an antenna tuning module (ATM) configured to vary a reactance about the first parasitic element, the first LC circuit and the switch being contained in the ATM.

20. The antenna of claim 1, said switch being coupled to one or more additional LC circuits, wherein the additional LC circuits are distinct from the first LC circuit, and wherein the switch is configured to selectively couple the first parasitic element to the first LC circuit, one of the one or more additional LC circuits, or a combination thereof.

21. An antenna, comprising:

a first antenna element positioned above a ground plane and forming an antenna volume therebetween;

a first parasitic element positioned outside of the antenna volume and adjacent to said first antenna element; and a first antenna tuning module coupled to the first parasitic element, the first antenna tuning module including at least a first switch and a first LC circuit coupled to the first switch, wherein said first LC circuit includes at least a first inductor and a first capacitor, the first switch further coupled to a processor configured with an algorithm for communicating control signals to the first switch, the first LC circuit, or a combination thereof.

22. The antenna of claim 21, wherein the first capacitor comprises a tunable capacitor for dynamically adjusting a capacitance associated therewith.

23. The antenna of claim 21, comprising two or more parasitic elements.

24. The antenna of claim 21, comprising two or more LC circuits, each of the LC circuits coupled to a distinct port of the first switch.

25. The antenna of claim 24, wherein the first inductor of the first LC circuit comprises a passive inductor, and wherein the first capacitor of the first LC circuit comprises a passive capacitor.

26. The antenna of claim 24, wherein the first capacitor of the first LC circuit comprises a tunable capacitor for dynamically adjusting a capacitance associated therewith.

27. The antenna of claim 21, wherein the antenna is configured for multiple modes, the antenna forming a distinct radiation pattern characteristic in each of the multiple modes, wherein upon adjusting a reactance associated with the first LC circuit the first parasitic element is configured to induce a change on the first antenna element for configuring the antenna in one of the multiple modes thereof.

28. The antenna of claim 21, wherein at least one port of the switch is short circuited to ground.

* * * * *